United States Patent [19]

Thierstein

[11] Patent Number: 4,526,362

[45] Date of Patent: Jul. 2, 1985

[54] METHOD AND APPARATUS FOR STORING PARTIALLY OVERLAPPING SHEETS OF PAPER OR THE LIKE

[75] Inventor: Hans Thierstein, Wiler near Utzenstorf, Switzerland

[73] Assignee: GRAPHA-Holding AG, Hergiswil, Switzerland

[21] Appl. No.: 389,981

[22] Filed: Jun. 18, 1982

[30] Foreign Application Priority Data

Jul. 15, 1981 [CH] Switzerland ..... 4633/81

[51] Int. Cl.[3] ..... B65H 29/66

[52] U.S. Cl. ..... 271/186; 271/212; 271/216; 242/59; 242/67.3 R

[58] Field of Search ..... 271/3, 207, 212, 216, 271/186, 213; 242/59, 67.3

[56] References Cited

U.S. PATENT DOCUMENTS

| | | | |
|---|---|---|---|
| 789,707 | 5/1905 | Bellamy | 242/59 |
| 3,781,005 | 12/1973 | Stobb | 271/186 |
| 4,213,576 | 7/1980 | Magnuson | 242/67.3 |
| 4,337,864 | 7/1982 | McLean | 271/207 X |
| 4,438,618 | 3/1984 | Honegger | 242/59 |

FOREIGN PATENT DOCUMENTS

| | | |
|---|---|---|
| 2207556 | 6/1975 | Fed. Rep. of Germany . |
| 1481429 | 7/1977 | United Kingdom . |

*Primary Examiner*—Richard A. Schacher
*Attorney, Agent, or Firm*—Peter K. Kontler

[57] ABSTRACT

Successive sheets of a stream of partially overlapping paper sheets are brought into contact with and are entrained by successive increments of an upwardly sloping running flexible band which is convoluted onto a rotary core to form with the sheets a bobbin wherein the sheets are confined between successive overlapping convolutions of the coiled band. The sheets of the stream are inverted ahead of the locus where they reach the running band so that the trailing portion of each preceding sheet overlies the leader of the next-following sheet. This reduces the likelihood of shifting of the sheets on impact against and during travel with the band upwardly toward the rotating core and renders it possible to dispense with a flexible element which is used in conventional apparatus to hold the sheets against slippage relative to the upwardly sloping band and which is convoluted with the band to thereby reduce the amount of space which is available in the bobbin for storage of confined sheets.

9 Claims, 1 Drawing Figure

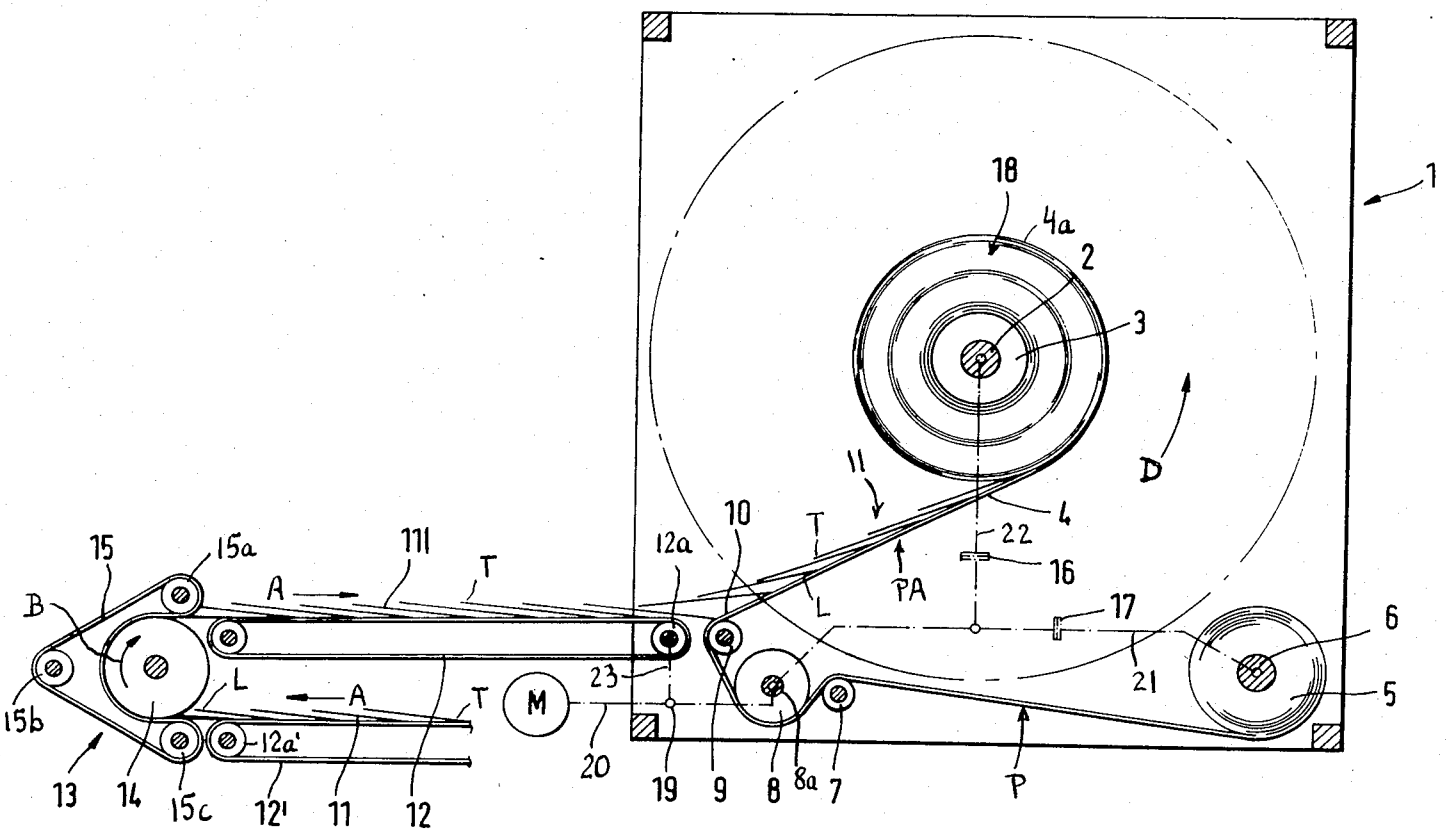
1
6
5
D
3
2
4a
18
4
16
22
17
21
P
PA
11
T
L
7
8a
8
10
9
12a
19
23
20
M
T
T
111
12
A
11
A
12a'
12'
15a
L
15c
14
15
13
B
15b

METHOD AND APPARATUS FOR STORING PARTIALLY OVERLAPPING SHEETS OF PAPER OR THE LIKE

BACKGROUND OF THE INVENTION

The present invention relates to a method and apparatus for manipulating sheets which form a stream of partially overlapping sheets, and more particularly to improvements in a method and apparatus for confining the sheets of such a stream between successive convolutions of a band which is coiled onto a driven core or the like.

An apparatus which can store the sheets of a stream of partially overlapping sheets (a so-called scalloped stream) between successive convolutions of a first flexible band is disclosed in German Pat. No. 2,207,556. Successive sheets of the stream are delivered to a downwardly moving portion of the running first band which advances toward the driven core whereon the first band is converted into a series of convolutions, i.e., into a portion of a bobbin whose convolutions confine and store the sheets therebetween. A drawback of the patented apparatus (and of the method which can be practiced with such apparatus) is that it necessitates the utilization of a second band which runs with the first band and serves to bias the sheets of the scalloped stream against the descending portion of the first band. This ensures that the sheets cannot leave the first band by inertia, gravity and/or for other reasons. The second band prevents the storing of relatively large numbers of sheets, i.e., such second band imposes limits upon the maximum number of sheets which can be stored between the convolutions of the two bands on the core. Thus, the advantage of having a second band (in order to reduce the likelihood of shifting of the sheets relative to the first band) is achieved at the expense of the capacity of the bobbin, i.e., the bobbin cannot store as many sheets as if the second band were absent.

OBJECTS AND SUMMARY OF THE INVENTION

An object of the invention is to provide an apparatus wherein a single flexible band suffices to make a bobbin in which the convolutions of the single band confine the sheets of a stream of partially overlapping paper sheets or the like.

Another object of the invention is to provide an apparatus wherein the sheets are advanced into the range of the single band, and wherein the single band is conveyed, in such a way that the sheets are not likely to be unduly misoriented or otherwise shifted relative to one another and/or relative to the band, even though a second flexible element is not necessary.

A further object of the invention is to provide an apparatus which ensures that a bobbin having a predetermined diameter can store a larger number of partially overlapping sheets than a bobbin which is formed in heretofore known apparatus.

An additional object of the invention is to provide the apparatus with novel and improved means for transmitting motion to various rotary and/or otherwise movable components.

Another object of the invention is to provide an apparatus wherein the orientation of sheets in the stream at the locus of delivery into the range of the running band is ideally suited for the storage of a relatively large number of sheets between the convolutions of the band and wherein the band is guided in such a way that the aforementioned second flexible element, which is an indispensable component part of conventional apparatus, can be omitted without adversely influencing the positioning and/or transport of sheets toward and between the convolutions of the bobbin.

An additional object of the invention is to provide a novel and improved method of manipulating the sheets of a stream of partially overlapping sheets ahead of the locus of contact with the single running band.

A further object of the invention is to provide a method of advancing and guiding a single band in such a way that it can properly engage, entrain and confine the sheets of a stream of partially overlapping sheets even though it is not assisted by a second flexible element.

One feature of the invention resides in the provision of a method of storing sheets, particularly sheets which are of partially overlapping sheets, between the convolutions of a flexible web, band or strip (hereinafter called band). The method comprises the steps of coiling the band onto a rotary core including conveying successive increments of the band along a predetermined path having an ascending portion at a level below the core (i.e., conveying the band from a level below and upwardly toward the core) so that the band is converted into a succession of convolutions which overlie each other and the innermost of which surrounds the core, and feeding successive sheets of the stream into the range of successive increments of the band in or in the region of the aforementioned ascending portion of the path so that the sheets are confined between the convolutions of the band on the core.

The method preferably further comprises the step of inverting successive sheets (or successive groups or sets of sheets) of the stream ahead of the location where the sheets reach and are entrained by the band. The arrangement is preferably such that the stream originally contains a succession of sheets wherein the leaders of next-following sheets overlie the trailing portions of preceding sheets, and the inverting step comprises turning successive sheets upside down so that the leader of each next-following sheet is overlapped by the trailing portion of the preceding sheet.

Another feature of the invention resides in the provision of an apparatus for storing sheets, which are supplied in the form of a stream of partially overlapping sheets, between the convolutions of a flexible band. The apparatus comprises a rotary core, a reel or an analogous source of band, means for conveying the band from the source to the core along a path having an ascending portion in the region below the core so that successive increments of the band which advance toward and are about to reach and to be convoluted around the core move upwardly, and means for feeding successive sheets of the stream against (i.e., into the range of) the band in the ascending portion of the path. The apparatus further comprises suitable support means (e.g., a stationary frame) for the core, for the source of band and for the feeding means.

The feeding means preferably comprises means for inverting successive sheets of the stream ahead of the ascending portion of the path. Such inverting means can comprise a system of roller means and belts for causing the leaders of successive sheets of the stream to be overlapped by the trailing portions of the preceding sheets (in contrast to the arraying of sheets ahead of the inverting means when the leader of each next-following sheet overlies the trailing portion of the preceding sheet).

The apparatus can further comprise common drive means for the reel of the source of band and for the core, and friction or slip clutch means interposed between the drive means on the one hand and the reel and/or core on the other hand. The conveying means can comprise a rotary element (such as a roller or a drum) which is rotated by the drive means, e.g., through the medium of a first power train; such apparatus can further comprise a second power train which derives motion from the first power train and transmits motion to the feeding means. For example, each power train can comprise a belt or chain transmission. The same holds true for power trains which connect the drive means with the core and with the reel; the power train which drives the core can derive motion from the power train which drives the reel or vice versa, and the aforementioned friction clutches or slip clutches can be installed in such power trains.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE of the drawing is a schematic partly elevational and partly vertical sectional view of an apparatus which embodies the present invention and wherein an electric motor constitutes the common drive means for the core, for the reel, for the conveying means and for the feeding means.

DESCRIPTION OF THE PREFERRED EMBODIMENTS

The drawing shows a support in the form of an upright frame 1 which carries a shaft 2 for a horizontal core 3 serving to collect successive convolutions of an elongated flexible band 4 which is stored on a reel 5. The reel 5 constitutes a source of band 4 and is mounted on a horizontal shaft 6 which is parallel to the shaft 2 and is installed in the frame 1. The leader of the band 4 is detachably secured to the core 3 in a manner not specifically shown in the drawing. For example, the core 3 can carry a clip, or it can have a slit for reception of the leader of the web 4. The core 3 and the reel 5 are non-rotatably secured to the respective shafts 2 and 6.

The conveying means which defines an elongated path P for transport of the band 4 from the reel 5 to the core 3 comprises a driven rotary element 8 whose shaft 8a is rotatably mounted in the frame 1, and a pair of guide rolls 7, 9 which flank the rotary element 8 and cooperate therewith to ensure that the band advances along the aforementioned elongated path P which has an ascending portion PA disposed at a level below the core 3. Successive increments of the band 4 in the ascending path portion PA advance toward the core 3, i.e., they are on their way toward the locus of conversion into successive outermost convolutions 4a of a bobbin 18 which accumulates on the core 3. The position of the guide roll 9 determines the lower end of the ascending portion PA of the path P, and such guide roll is adjacent to the location or station 10 where successive increments of the running band 4 engage and entrain successive sheets 111 of a continuous stream 11 of partially overlapping sheets. The means for feeding successive sheets 111 of the stream 11 to the station 10 comprises a first endless belt, chain or band conveyor 12', an inverting or turn-around device 13 for successive sheets 111, and a second endless band, chain or belt conveyor 12 whose discharge end is adjacent to the station 10. The manner in which the stream 11 is formed on the conveyor 12' or prior to reaching the conveyor 12' forms no part of the invention; such stream can consist of folded-over paper sheets 111 or groups of paper sheets 111 each of which has a leader L and a trailing portion T, as considered in the direction of transport of sheets 111 (note the arrows A). It will be noted that, in the illustrated embodiment, the conveyors 12' and 12 advance successive sheets 111 of the stream 11 in opposite directions.

The inverting device 13 comprises a rotary drum 14 and an endless belt or band 15 which is trained over guide rolls or pulleys **15*a*, 15*b* or 15*c* so that one of its reaches overlies approximately one-half of the periphery of the drum 14. The leaders L of sheets 111 in the non-inverted stream 11 (on the conveyor 12') overlie the trailing portions T of the preceding sheets 111. On the other hand, the trailing portions T of sheets 111 which constitute the inverted stream 11 on the conveyor 12 overlie the leaders L of the respective next-following sheets 111. This is achieved in that the leaders L of successive sheets 111 on the conveyor 12' are caused to impinge against the exposed portion of the peripheral surface of the drum 14 (which rotates in the direction of arrow B) and are caused to enter the space or gap between the drum 14 and the adjacent reach of the belt 15. The parts 14 and 15 define an arcuate path extending along an arc of approximately (or even more than) 180 degrees so that the sheets 111 are turned upside down with the result that the trailing portions T of successive sheets 111 emerging from the gap between the parts 14 and 15** overlie the leaders L of the next-following sheets.

Other types of inverting or turn-around devices can be used with equal or similar advantage.

The drive means for various rotary or otherwise movable parts of the improved apparatus comprises a prime mover M (e.g., a variable-speed electric motor), a first power train 20 (e.g., a chain or belt conveyor) which receives motion from the output element of the motor M and drives the shaft 8a of the rotary element 8, a second power train 21 which receives motion from the motor M through the medium of the shaft 8a and drives the shaft 6, a third power train 22 which receives motion from the power train 21 and serves to rotate the shaft 2 in the direction of arrow D, and a fourth power train 23 which derives motion from the power train 20 and drives the pulley **12*a* for the conveyor 12 (the power train 23 or a further power train can transmit torque to one of the pulleys 12*a'* for the conveyor 12'). The take-off where the power train 23 receives motion from the power train 20 is shown at 19. A friction clutch or slip clutch 17 is installed in the power train 21, and a second friction clutch or slip clutch 16 is installed in the power train 22. The common drive means (motor M) for the rotary element 8, pulley 12*a* and shafts 2, 6 ensures that the ratio of the speed of the running band 4 to the speed of the conveyor 12 can remain constant (e.g., such ratio preferably equals one-to-one). The slip clutches 16 and 17 ensure that the speed of the shaft 6** can increase proportionally with decreasing speed of the shaft 2 and vice versa, depending upon whether the bobbin 18 is convoluted onto or is being unwound from the core 3. The motor M can be of the reversible type so that it can be used to drive the shaft 6 in a direction to wind the band 4 thereon.

It has been found that the improved apparatus is unlikely to cause any undesirable shifting of sheets 111 relative to one another during and subsequent to transport toward the station 10. This is attributed, at least to a substantial degree, to the feature that successive sheets 111 of the inverted stream 11 are transported into an ascending portion PA of the path P for the band 4, i.e., into a path portion wherein the band 4 travels upwardly on its way toward the core 3 thereabove. In other words, that portion of the band 4 which is contacted by and entrains successive increments of the inverted stream 11 travels upwardly rather than along a descending or downwardly sloping path. The sheets 111 are fed into the upper side of the band 4 in the ascending path portion PA, i.e., onto that side which faces the core 3.

The inverting device 13 (or an analogous or equivalent inverting device) can be installed at the inlet to or at the discharge end of the path for the stream 11. For example, the inverting device 13 can be installed between the pulley 12a for the conveyor 12 and the station 10. It is merely important or desirable to ensure that the leaders L of successive inverted sheets 111 are first to contact the upper side of the upwardly sloping band 4 in the ascending path portion PA. This can be readily seen in the drawing. The conveyor 12' can receive sheets 111 directly from a folding, gathering, stacking or other machine, not shown. The placing of the inverting device 13 (or an analogous inverting device) ahead of the station 10 (where the sheets 111 of the stream 11 reach the running band 4) ensures that the bobbin 18 can store a larger quantity of sheets 111 than in heretofore known apparatus wherein the inverting device is adjacent to the stream which is drawn off a bobbin and is fed to the next processing station or machine.

It is clear that the illustrated drive means and power trains constitute but one form of means for transmitting torque or other type of motion to mobile component parts of the improved apparatus. All that counts is to ensure that the peripheral speed of the reel 6 matches the peripheral speed of the bobbin 18 and that such speeds are properly related to and do not unduly fluctuate relative to the speed at which the stream 11 is being fed to the station 10. The power train 23 ensures that the speed of the band 4 is invariably and necessarily in an optimum relationship with the speed of the stream 11.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of storing sheets, which are supplied in the form of a stream containing a succession of partially overlapping sheets wherein the leaders of the next-following sheets overlie the trailing portions of the preceding sheets, between the convolutions of a flexible band, comprising the steps of coiling the band onto a rotary core including conveying successive increments of the band from a level below and upwardly toward the core so that the band is converted into a succession of convolutions which overlie each other; feeding successive sheets of the stream into the range of said successive increments of the band so that the sheets are confined between the convolutions of the band on the core; and inverting successive sheets of the stream ahead of the location where the sheets reach the band, comprising turning successive sheets upside down so that the leader of each next-following sheet is overlapped by the trailing portion of the preceding sheet.

2. Apparatus for storing sheets, which are supplied in the form of a stream containing a succession of partially overlapping sheets wherein the leaders of the next-following sheets overlie the trailing portions of the preceding sheets, between the convolutions of a flexible band, comprising a rotary core; a source of band; means for conveying the band from said source to said core along a path having an ascending portion in the region below said core so that successive increments of the band which advance toward and are convoluted on said core advance upwardly; and means for feeding successive sheets of the stream against the band in said ascending portion of the path, including means for inverting successive sheets of the stream ahead of said ascending portion of said path, said inverting means including means for turning successive sheets upside down so that the leader of each next-following sheet is overlapped by the trailing portion of the preceding sheet.

3. The apparatus of claim 2, further comprising support means for said core, said source and said feeding means.

4. The apparatus of claim 2, wherein said source comprises a rotary reel and further comprising common drive means for said core and said reel.

5. The apparatus of claim 4, further comprising slip clutch means interposed between said drive means and said reel.

6. The apparatus of claim 4, further comprising slip clutch means interposed between said drive means and said core.

7. The apparatus of claim 2, wherein said conveying means comprises a rotary element and further comprising drive means, a first power train connecting said drive means with said rotary element, and a second power train deriving motion from said first power train and arranged to transmit motion to said feeding means.

8. A method of storing sheets, which are supplied in the form of a stream containing a succession of partially overlapping sheets wherein the leaders of the next-following sheets overlie the trailing portions of the preceding sheets, between the convolutions of a flexible band, comprising the steps of coiling the band onto a rotary core including conveying successive increments of the band toward the core so that the band is converted into a succession of convolutions which overlie each other and has an upper side facing the core and an underside immediately ahead of the location where the conversion into the convolutions occurs; feeding successive sheets of the stream onto the upper side of the band so that the sheets are confined between the convolutions of the band on the core; and inverting successive sheets of the stream ahead of the location where the sheets reach the band, comprising turning successive sheets upside down so that the leader of each next-following sheet is overlapped by the trailing portion of the preceding sheet and contacts the upper side of the band.

9. Apparatus for storing sheets, which are supplied in the form of a stream containing a succession of partially overlapping sheets wherein the leaders of the next-following sheets overlie the trailing portions of the preceding sheets, between the convolutions of a flexible band, comprising a rotary core; a source of band; means for conveying the band from said source to said core so that each of a succession of increments of the band which advance toward and are convoluted on said core has an upper side facing the core and an underside in a region immediately ahead of the location where the band is convoluted onto said core; and means for feeding successive sheets of the stream onto said upper side of the band, including means for inverting successive sheets of the stream ahead of said region and said inverting means including means for turning successive sheets upside down so that the leader of each next-following sheet is overlapped by the trailing portion of the preceding sheet and contacts said upper side of the band.

* * * * *